US008691020B2

(12) United States Patent
Evers

(10) Patent No.: US 8,691,020 B2
(45) Date of Patent: Apr. 8, 2014

(54) WASHING AND CLEANING SYSTEM FOR CONTAINER TREATMENT MACHINES OF THE FOOD INDUSTRY

(75) Inventor: Hartmut Evers, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/321,749

(22) PCT Filed: Aug. 27, 2010

(86) PCT No.: PCT/EP2010/005265

§ 371 (c)(1),
(2), (4) Date: Nov. 21, 2011

(87) PCT Pub. No.: WO2011/026590

PCT Pub. Date: Mar. 10, 2011

(65) Prior Publication Data

US 2012/0067375 A1 Mar. 22, 2012

(30) Foreign Application Priority Data

Sep. 5, 2009 (DE) ..... 10 2009 040 138

(51) Int. Cl.

| | |
|---|---|
| ***B08B 3/00*** | (2006.01) |
| ***B08B 3/12*** | (2006.01) |
| ***B08B 3/14*** | (2006.01) |
| ***B08B 6/00*** | (2006.01) |
| ***B08B 7/00*** | (2006.01) |
| ***B08B 7/04*** | (2006.01) |

(52) U.S. Cl.
USPC ..... 134/18; 134/42; 134/72; 134/180; 134/181

(58) Field of Classification Search
USPC ..... 134/180, 181
See application file for complete search history.

(56) References Cited

U.S. PATENT DOCUMENTS

| | | | | |
|---|---|---|---|---|
| 5,755,246 | A * | 5/1998 | Carl et al. | 134/73 |
| 6,301,930 | B1 | 10/2001 | Warner et al. | |
| 6,454,857 | B1 | 10/2002 | Miller | |
| 7,143,793 | B2 | 12/2006 | Vaughn | |
| 7,325,667 | B1 | 2/2008 | Damick et al. | |
| 2002/0139436 | A1 | 10/2002 | Rosen et al. | |
| 2005/0100625 | A1 * | 5/2005 | Tooman et al. | 425/145 |
| 2006/0086065 | A1 | 4/2006 | Tomalesky et al. | |
| 2007/0012334 | A1 * | 1/2007 | Wolters | 134/1 |
| 2007/0056612 | A1 * | 3/2007 | Robert et al. | 134/61 |
| 2007/0192973 | A1 * | 8/2007 | Eklund et al. | 15/50.1 |
| 2008/0166208 | A1 * | 7/2008 | Lester et al. | 414/217 |

FOREIGN PATENT DOCUMENTS

| | | | | |
|---|---|---|---|---|
| DE | 3605482 | | 8/1986 | |
| DE | 3741054 | A1 * | 6/1989 | B65G 15/60 |
| DE | 20021463 | | 4/2001 | |
| DE | 20019305 | | 6/2001 | |
| DE | 10224100 | A1 * | 4/2003 | F16C 32/04 |
| DE | 69816343 | | 6/2004 | |
| EP | 0374586 | | 3/1993 | |
| WO | 99/52655 | | 10/1999 | |
| WO | 02/090007 | | 11/2002 | |

* cited by examiner

*Primary Examiner* — Joseph L Perrin
*Assistant Examiner* — Levon J Shahinian
(74) *Attorney, Agent, or Firm* — Occhiuti & Rohlicek LLP

(57) ABSTRACT

The invention relates to a container treatment machine, in particular a filling, closing or rinsing unit for containers, such as bottles, cans, barrels, kegs etc., comprising a container feed, a container discharge, at least one feed line for at least one product, and a cleaning device (3) for cleaning the outer surfaces by means of a cleaning fluid (13), characterized in that the cleaning device (3) comprises a robot (4) and a track (5), wherein the track (5) runs around the rotational axis thereof in at least one angular region, wherein the robot (4) is arranged on or at said track (5) and can be driven by means of a linear drive (8).

15 Claims, 2 Drawing Sheets

WASHING AND CLEANING SYSTEM FOR CONTAINER TREATMENT MACHINES OF THE FOOD INDUSTRY

CROSS REFERENCE TO RELATED APPLICATIONS

This application claims the benefit of the priority date of international application no. PCT/EP2010/005265, filed Aug. 27, 2010, which claims the benefit of the priority date of German application no. 10 2009 040 138.5, filed Sep. 5, 2009. Both applications are incorporated herein by reference.

FIELD OF INVENTION

The invention relates to an apparatus for cleaning container treatment machines.

Machines for treating containers, such as bottles, cans or barrels, in particular kegs, are known. In general, one machine is used for one treatment step. Particularly when rinsing, filling and closing containers, machine and container surfaces are soiled from outside by overflowing or splashed product. The surrounding environment is also a source of soiling, so that dust, particles, etc. adhere to the moist machine and container surfaces.

In order to remove this soiling, nozzle systems are provided which rinse away this soiling in a torrent-like manner. U.S. Pat. No. 7,143,793 B2 discloses such a system, in which there is arranged in front of the rotating filling machine a stationary nozzle block which comprises nozzles directed radially towards the filler axis and a nozzle arm which projects between the filling valve and the container holder and the nozzles of which are directed vertically upwards.

EP 0 374 586 B1 discloses a cleaning unit for a linear filling unit, in which a cleaning carriage, which is equipped with a plurality of nozzles, can be moved back and forth horizontally on a rail inside the filling unit.

These apparatuses, which are suitable in principle, have the disadvantage that a high volume of water and cleaning agent is required in order to ensure a sufficiently great torrent of fluid which reaches all the surfaces to be cleaned.

SUMMARY

The object of the invention is therefore to provide an apparatus and a method which minimizes the consumption of water and cleaning agents.

The core of the container treatment apparatus consists of a track running around all or part of the circumference, and a drive and support rail on which a robot or robot arm can move. As the drive for the robot or robot arm, a linear drive is provided which is ideally configured as a linear direct drive. Such electromagnetic linear direct drives which are known and can be used are torque motors, tubular linear motors or polysolenoid linear motors. The track should be provided around the treatment apparatus at least over an angle range of 120° or more, in order to be able to reach in an optimal manner all the outer surfaces of a container treatment apparatus.

By virtue of this cleaning device, which substantially consists of the robot or robot arm and the drive and support rail as well as the supply lines, each position on a container treatment machine or apparatus can be reached very quickly and can be rinsed in an absolutely targeted manner and with minimal consumption of water and cleaning agent. The robot or robot arm has at least two, ideally six, axes and is telescopically height-adjustable with at least one arm segment.

Due to the high speeds of travel, this cleaning system is able to use even brief breaks in operation to clean parts or individual components of the container treatment unit or apparatus. In particular it is possible, using the cleaning device, to carry out cleaning of small areas after the exchange of replacement parts, which is in turn advantageous from an energy and cost point of view.

Of particular advantage is the electromagnetic drive, which is particularly fast and exhibits low noise and vibration and allows extremely high positioning accuracy.

The system components for the linear drive require, in addition to the motor and the magnetic track, a servo controller and a high-resolution linear scale including a reading head. A considerable minimizing of positioning times can thus be achieved in comparison to conventional, wheel-driven rail systems.

The track may be configured as a rail or rail system. It is possible that the track comprises at least one support or load-carrying rail, wherein a drive rail which accommodates the magnets may be separate from or integrated in the load-carrying or support rail. Preferably, the track is arranged above the container treatment apparatus. It is advantageous if the track for the robot or robot arm is attached to the protective housing surrounding or adjoining the container treatment apparatus. It is advantageous if at least one set of points is provided in the track in order to switch from a first section, which is assigned for example to a first container treatment apparatus, to a second section, which is assigned for example to a second container treatment apparatus.

In an improved version, the track itself is configured as a fluid-carrying element in that portions of the track, for example a rail along the track, are configured as square hollow bodies. Ideally, at least one valve coupling is provided in or on the hollow body, to which coupling the robot or robot arm can autonomously fluidically connect. The robot or robot arm thus becomes independent of a central fluid supply. If the connection of the robot or robot arm to the valve coupling takes place via a hose piece, the robot can continue to move in a smaller sub-section of the track.

The fluid supply via a pipeline (hollow body) integrated in the track has the advantage that the robot or robot arm is reduced in weight since neither a long supply hose nor a fluid reservoir has to be provided and moved.

In one embodiment, it is provided that the robot or robot arm can grip and agitate a combined spray and suction head in order to clean the track itself. To this end, it is advantageous if the track and in particular the magnets are immediately dried again once they have been wetted with a conductive fluid. In this cleaning head, two sections are provided which are separated from one another by a separating element, for example a sealing or wiping lip. In the first segment of the spray and suction head, the fluid is discharged in a torrent, and in the other element the adhering residual fluid is sucked up and conveyed away. According to the respective control signals, the robot or robot arm can automatically take this combined spray and suction head, as well as all the other spraying and/or cleaning heads, from one or more provisioning stations provided on the track. When this or a comparable suction head is provided, it is advantageous if at least a portion or a section of the track is configured as a hollow body which serves as a suction line and to which a central or decentral compressor is connected.

DESCRIPTION OF THE FIGURES

Further advantageous embodiments of the invention are disclosed in the dependent claims and in the following description of the figures. In the figures:

In the different figures, identical parts are generally provided with the same references and will therefore also be described only once.

DETAILED DESCRIPTION

Figure 1:
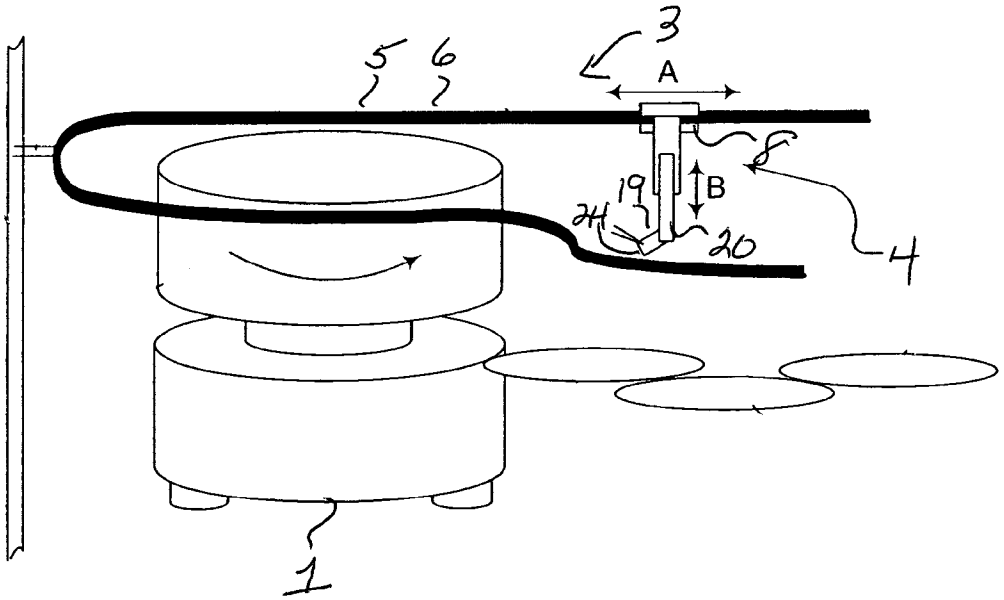
FIG. 1 shows a schematic diagram of a washing and cleaning system.

FIG. 1 shows a container treatment apparatus 1, in particular a filling, closing or rinsing unit for containers, such as for example bottles, cans, barrels, kegs, etc. The containers are shown schematically in FIG. 1. The container treatment apparatus 1 comprises a container feed, a container discharge, at least one feed line for at least one product, and a cleaning device 3 for cleaning the outer surfaces by means of a cleaning fluid.

The cleaning device 3 comprises a robot 4 and a track 5, wherein the track 5 runs around the rotational axis thereof at least over an angle range. The robot 4 is arranged on or at said track 5 and can be driven by means of a linear drive 8, and can be moved along said track (double-headed arrow A).

FIG. 1 also shows a supply device 7 (e.g. power, cleaning fluid, etc.) which is connected to the track 5.

It is therefore essential that the container treatment apparatus 1 comprises a track 5 running around part or all of the circumference, and a drive and support rail 6 on which the robot 4 or a robot arm can move. By way of example, the drive or support rail 6 forms the track 5. As the drive for the robot 4 or robot arm, a linear drive 8 (FIG. 2) is provided which is ideally configured as a linear direct drive.

The track 5 is preferably provided around the treatment apparatus at least in an angle range of 120° or more, in order to be able to reach in an optimal manner all the outer surfaces of the container treatment apparatus 1. In FIG. 1, the track 5 is arranged by way of example around approximately three-quarters of the circumference of the container treatment apparatus 1.

Figure 2:
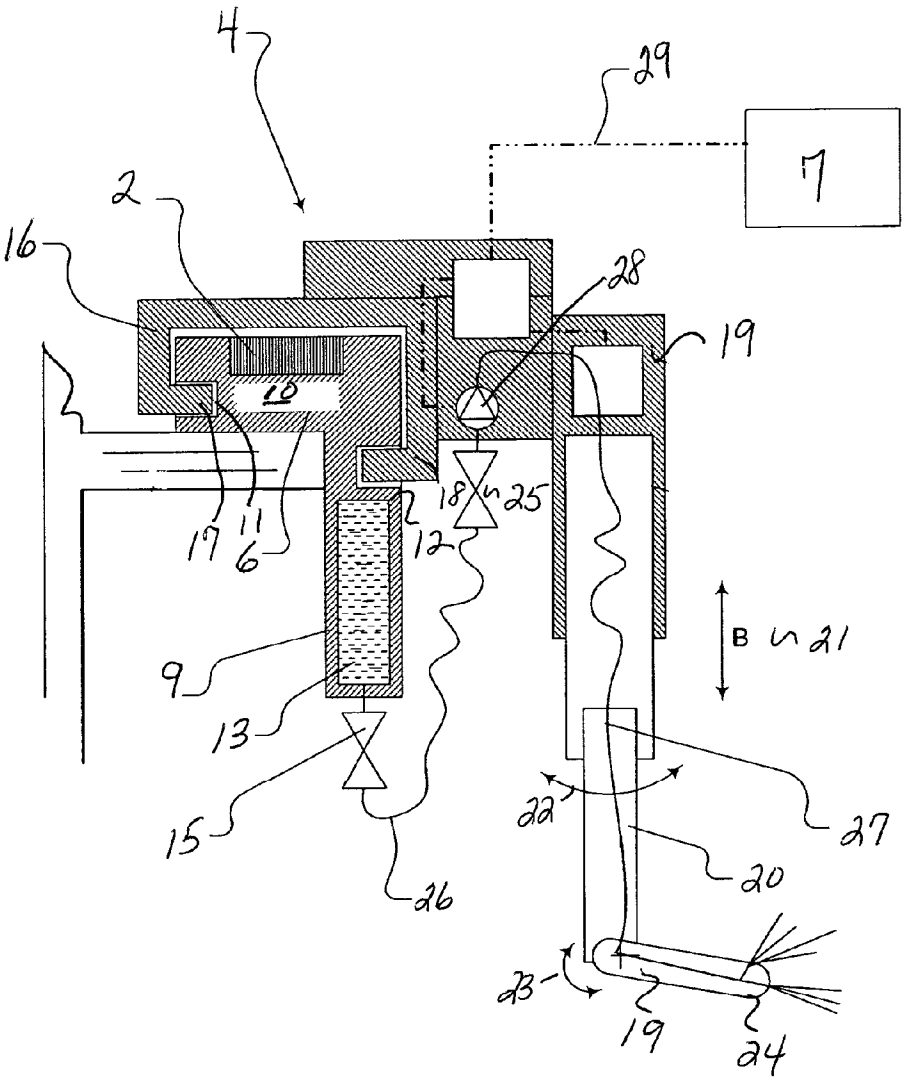
FIG. 2 shows the track and robot or robot arm as a single unit.

Details of the drive or support rail with the robot 4 arranged in a movable manner thereon can be seen in FIG. 2.

For the sake of simplicity, the drive or support rail 6 will be referred to below as the drive rail 6. As seen in the illustrated cross-section of FIG. 2, the drive rail 6 has virtually the shape of an upside-down L with an upright web 9 that is vertical in the plane of the drawing and a transverse web 10 that extends to the left in the plane of the drawing.

The drive rail 6 has guide grooves 11 and 12 and an integrated magnet 2. The guide groove 11 is incorporated in the transverse web 10, while the guide groove 12 is arranged in the upright web 9 below, for example immediately below, the transverse web 10.

The linear drive 8, configured by way of example as an electromagnetic direct drive, is arranged at the top in the transverse web 10.

The upright web 9 is configured in some sections as a hollow body, for example as a square hollow body, in which cleaning agent 13 is accommodated, so that the support rail 6 itself is advantageously designed to convey fluid.

The upright web 9 has, at a bottom 14 in the plane of the drawing, a valve coupling 15 which will be discussed in further detail below.

The robot 4 has a guide region 16 which is configured so as to correspond to the support rail 6 and encompasses the support rail 6, and which engages with guide webs 17 and 18 in the guide grooves 11 and 12. The guide web 17 engages in the guide groove 11, while the guide web 18 engages in the guide groove 12. The robot 4 is thus mounted such as to be movable along the drive rail 6. The guide region 16 is adjoined by a cleaning head 19 with a cleaning arm 20.

The cleaning arm 20 is telescopically height-adjustable, as shown by means of the double-headed arrow 21. Furthermore, other movement possibilities of different arm segments are shown by means of the double-headed arrows 22 and 23. A spray head 24 is arranged on the cleaning arm 20.

Arranged on the cleaning head 19 is a valve coupling 25 which is connected to the valve coupling 15 of the upright web 9 via a hose piece 26 or other such suitable connecting means. Further fluid-conveying connecting elements 27 lead preferably from the valve coupling 25, through the cleaning head 19 and inside the cleaning arm 20 to the spray head 24. A control element 28, for example in the form of a non-return valve, is arranged above the valve coupling 25 in the plane of the drawing.

A central fluid supply 29 is shown in dash-dotted line, but this may also be omitted due to the advantageous configuration of the drive rail 6 as a fluid-conveying drive rail 6. Via suitable means, the hollow body is connected to the supply device 7 so that the fluid reservoir in the upright web 9 can be supplied with cleaning agent. By means of the upright web 9 configured at least in some sections as a hollow body, the robot 4 is virtually independent of a central fluid supply, so that the weight of the robot 4 is reduced since the required cleaning agent is accommodated in the support rail 6 itself. By means of the hose piece 26, the robot 4 is movable relative to the support rail 6 in a section corresponding to the effective length of the hose piece 26. The hose piece 26 may also be elastic to a certain extent, i.e. stretchable, so that destruction of the hose piece 26 can be avoided if the robot 4 is moved over a distance greater than the effective length of the hose piece 26.

The robot 4 or the cleaning arm 20 thereof may be configured in such a way that it grips the hose piece 26 in a suitable manner and automatically connects it to or disconnects it from the valve coupling 15. The robot 4, upon reaching the maximum displacement travel which is limited by the effective length of the hose piece 26, can thus disconnect the connection to the valve coupling 15 and effect a connection to another valve coupling 15.

With the advantageously designed cleaning device 3, any point on the container treatment apparatus 1 can be cleaned with cleaning agent. Of course, the containers 2 can also be cleaned by the cleaning device 3.

LIST OF REFERENCES

1 container treatment apparatus
2 integrated magnet
3 cleaning device
4 robot/robot arm
5 track
6 drive or support rail
7 supply device
8 linear drive
9 upright web of 6
10 transverse web of 6
11 guide groove in 6 or 10
12 guide groove in 6 or 9
13 cleaning agent in 6 or 9
14 bottom
15 valve coupling on 9
16 guide region
17 guide web on 16
18 guide web on 16

19 cleaning head
20 cleaning arm
21 movement arrow
22 movement arrow
23 movement arrow
24 spray head
25 valve coupling
26 hose piece
27 connecting elements
28 control element
29 central fluid supply

The invention claimed is:

1. An apparatus comprising a container treatment machine and a container-treatment-machine cleaning device for cleaning said container treatment machine, wherein said container treatment machine comprises a container feed, a container discharge, and a feed line for a product, and wherein said container-treatment-machine cleaning device for cleaning said container treatment machine is configured for cleaning outer surfaces of said container treatment machine with cleaning fluid, wherein said container-treatment-machine cleaning device for cleaning said container treatment machine comprises a track, a robot, and a linear direct drive, wherein said track extends around a rotational axis of said container treatment machine over an angular range, wherein said robot is arranged on said track, wherein said robot is moveable on said track for cleaning said container treatment machine, and wherein said linear direct drive is configured to cause said robot to move along said track for cleaning outer surfaces of said container treatment machine.

2. The apparatus of claim 1, wherein said linear direct drive comprises a torque motor.

3. The apparatus of claim 1, wherein said linear direct drive comprises a tubular linear motor.

4. The apparatus of claim 1, wherein said linear direct drive comprises a polysolenoid linear motor.

5. The apparatus of claim 1, wherein said track comprises a rail.

6. The apparatus of claim 1, wherein said track comprises a support rail.

7. The apparatus of claim 1, wherein said track comprises a support rail, and wherein a drive rail accommodating magnets is integrated with said support rail.

8. The apparatus claim 1, wherein said track is arranged above said container treatment machine.

9. The apparatus of claim 1, wherein said track comprises a section configured as a hollow body through which cleaning fluid flows toward said robot.

10. The apparatus of claim 1, wherein said track comprises a section configured as a hollow body that serves as a suction line and through which fluid can flow away from said robot and said container treatment machine.

11. The apparatus of claim 1, wherein said track comprises a section configured as a hollow body, said apparatus further comprising valve couplings for providing fluid communication between said robot and said section.

12. The apparatus of claim 1, wherein said track for said robot is attached to a protective housing surrounding or adjoining said apparatus.

13. The apparatus of claim 1, further comprising a set of points on said track for switching from a first section, which is assigned to a first container treatment apparatus, to a second section, which is assigned to a second container treatment apparatus.

14. The apparatus of claim 1, further comprising a treatment head for said robot for cleaning said track and immediately drying said track after cleaning.

15. A method for cleaning a container treatment machine, said method comprising: providing a container treatment machine and a container-treatment-machine cleaning device for cleaning said container treatment machine, wherein said container treatment machine comprises a container feed, a container discharge, and a feed line for a product, and wherein said container-treatment-machine cleaning device for cleaning said container treatment machine is configured for cleaning outer surfaces of said container treatment machine with cleaning fluid, wherein said container-treatment-machine cleaning device for cleaning said container treatment machine comprises a track, a robot, and a linear direct drive, wherein said track extends around a rotational axis of said container treatment machine over an angular range, wherein said robot is arranged on said track, wherein said robot is moveable on said track for cleaning said container treatment machine, and wherein said linear direct drive is configured to cause said robot to move along said track for cleaning outer surfaces of said container treatment machine, said method comprising moving said robot along said track using said linear direct drive.

* * * * *